US010334347B2

(12) United States Patent
Kofman et al.

(10) Patent No.: US 10,334,347 B2
(45) Date of Patent: Jun. 25, 2019

(54) EARBUD INSERTION SENSING METHOD WITH CAPACITIVE TECHNOLOGY

(71) Applicant: BOSE CORPORATION, Framingham, MA (US)

(72) Inventors: Igor Kofman, Weston, MA (US); Jay Klemme, Framingham, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/671,376

(22) Filed: Aug. 8, 2017

(65) Prior Publication Data

US 2019/0052951 A1 Feb. 14, 2019

(51) Int. Cl.
*H04R 1/10* (2006.01)

(52) U.S. Cl.
CPC ..... *H04R 1/1041* (2013.01); *H04R 1/1016* (2013.01); *H04R 2420/07* (2013.01); *H04R 2460/03* (2013.01); *H04R 2460/15* (2013.01)

(58) Field of Classification Search
CPC . H04R 1/1041; H04R 1/1016; H04R 2460/03
USPC ..... 381/380, 74
See application file for complete search history.

(56) References Cited

U.S. PATENT DOCUMENTS

| | | | |
|---|---|---|---|
| 7,010,332 | B1 | 3/2006 | Irvin et al. |
| 7,212,835 | B2 | 5/2007 | Mantyjarvi et al. |
| 7,406,179 | B2 | 7/2008 | Ryan |
| 7,769,353 | B2 | 8/2010 | Dietrich et al. |
| 7,805,171 | B2 | 9/2010 | Alameh et al. |
| 7,930,007 | B2 | 4/2011 | Andreasson |
| 7,945,297 | B2 | 5/2011 | Philipp |
| 8,006,002 | B2 | 8/2011 | Kalayjian et al. |
| 8,045,727 | B2 | 10/2011 | Philipp |
| 8,238,567 | B2 | 8/2012 | Burge et al. |
| 8,259,984 | B2 | 9/2012 | van der Bilt |
| 8,315,406 | B2 | 11/2012 | Kon |
| 8,315,876 | B2 | 11/2012 | Reuss |
| 8,335,312 | B2 | 12/2012 | Gerhardt et al. |
| 8,428,053 | B2 | 4/2013 | Kannappan |
| 8,498,439 | B2 | 7/2013 | Bae et al. |
| 8,538,009 | B2 | 9/2013 | Gerhardt et al. |
| 8,559,621 | B2 | 10/2013 | Gerhardt et al. |
| 8,630,425 | B2 | 1/2014 | Chang et al. |
| 8,647,270 | B2 | 2/2014 | LeBoeuf et al. |

(Continued)

FOREIGN PATENT DOCUMENTS

| | | |
|---|---|---|
| CN | 202721822 U | 2/2013 |
| CN | 102761816 B | 9/2014 |

(Continued)

OTHER PUBLICATIONS

International Search Report and Written Opinion from corresponding International Application No. PCT/US2018/044936 dated Oct. 15, 2018.

*Primary Examiner* — Vivian C Chin
*Assistant Examiner* — Douglas J Suthers
(74) *Attorney, Agent, or Firm* — Lando & Anastasi, LLP

(57) ABSTRACT

An earbud includes a capacitive sensor including at least one conductive trace and a controller configured to provide an indication of the earbud being inserted into an ear of a user responsive to detecting changes in capacitance of one of the at least one conductive trace relative to ground or different conductive traces relative to one another.

25 Claims, 14 Drawing Sheets

(56) References Cited

U.S. PATENT DOCUMENTS

| | | | |
|---|---|---|---|
| 8,686,924 | B2 | 4/2014 | Braun et al. |
| 8,699,719 | B2 | 4/2014 | Johnson, Jr. et al. |
| 8,705,784 | B2 | 4/2014 | Haartsen et al. |
| RE44,980 | E | 7/2014 | Sargaison |
| 8,798,042 | B2 | 8/2014 | Kannappan |
| 8,805,452 | B2 | 8/2014 | Lee |
| 8,831,242 | B2 | 9/2014 | Brown et al. |
| 8,907,867 | B2 | 12/2014 | Wong et al. |
| 8,954,177 | B2 | 2/2015 | Sanders |
| 9,081,572 | B2 | 7/2015 | Philipp et al. |
| 9,094,501 | B2 | 7/2015 | Smailagic et al. |
| 9,094,764 | B2 | 7/2015 | Rosener |
| 9,117,443 | B2 | 8/2015 | Walsh |
| 9,124,970 | B2 | 9/2015 | Rabii et al. |
| 9,232,308 | B2 | 1/2016 | Murata et al. |
| 9,280,239 | B2 | 3/2016 | Rosener |
| 9,286,742 | B2 | 3/2016 | Rosener et al. |
| 9,338,540 | B2 | 5/2016 | Nicholson |
| 9,344,792 | B2 | 5/2016 | Rundle |
| 9,442,523 | B2 | 9/2016 | Lee et al. |
| 9,479,860 | B2 | 10/2016 | Kwatra et al. |
| 9,486,823 | B2 | 11/2016 | Andersen et al. |
| 9,549,055 | B2 | 1/2017 | Widell et al. |
| 9,590,680 | B1 | 3/2017 | Reuss et al. |
| 9,648,409 | B2 | 5/2017 | Puskarich |
| 9,838,775 | B2 | 12/2017 | Qian et al. |
| 2006/0233413 | A1* | 10/2006 | Nam ..... H04R 1/1041 381/380 |
| 2010/0322430 | A1 | 12/2010 | Isberg |
| 2013/0279724 | A1 | 10/2013 | Stafford et al. |
| 2015/0264472 | A1 | 9/2015 | Aase |
| 2017/0087364 | A1* | 3/2017 | Cartledge ..... A61N 1/36014 |
| 2017/0094389 | A1 | 3/2017 | Saulsbury et al. |

FOREIGN PATENT DOCUMENTS

| | | | |
|---|---|---|---|
| CN | 103002373 | B | 5/2015 |
| CN | 205071294 | U | 3/2016 |
| CN | 205081948 | U | 3/2016 |
| DE | 102015219310 | A1 | 4/2017 |
| EP | 2415276 | A1 | 2/2012 |
| JP | 4737496 | B2 | 8/2011 |
| WO | 2010049543 | A2 | 5/2010 |

* cited by examiner

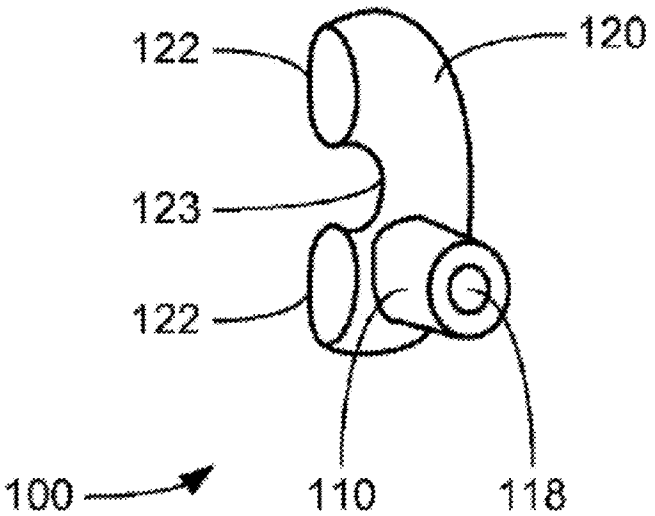
FIG. 1b
FIG. 1a
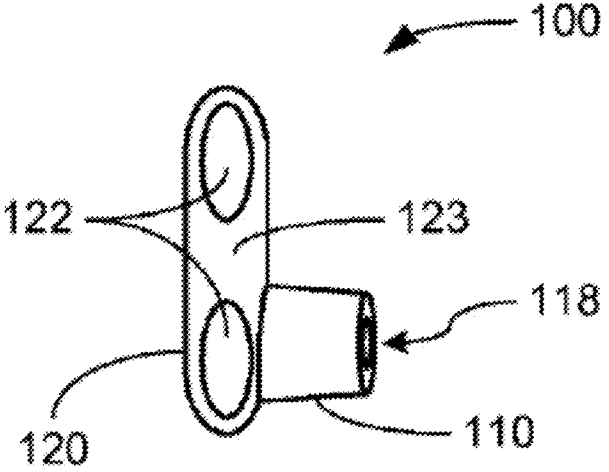

EARBUD INSERTION SENSING METHOD WITH CAPACITIVE TECHNOLOGY

TECHNICAL FIELD

Aspects and implementations of the present disclosure are directed generally to earbuds and to systems and methods for extending the battery life or controlling audio playback of same.

BACKGROUND

Earbuds for use with consumer electronic devices, for example, audio players and wireless communications devices (e.g., cell phones and personal data assistant devices incorporating cell phone capabilities) may be connected to an electronic device via a wired connection or wirelessly. Consumers generally prefer earbuds that are small and lightweight and comfortable to wear. Small and lightweight earbuds, however, can accommodate batteries of only a limited size and thus, a limited capacity. If a user accidentally powers on and sends audio to be played to an earbud while it is not in the ear of the user, or removes the earbud from the ear without first terminating rendering of audio by the earbud, battery life of the earbud may be unintentionally wasted. Further, it may be desirable to automatically control aspects of audio playback when the earbuds are placed in a user's ear or taken out of a user's ear.

SUMMARY

In accordance with an aspect of the present disclosure, there is provided an earbud. The earbud comprises a capacitive sensor including at least one conductive trace and a controller configured to provide an indication of the earbud being inserted into an ear of a user responsive to detecting changes in capacitance of one of the at least one conductive trace relative to ground or different conductive traces relative to one another.

In some implementations, the earbud further comprises a nozzle configured to be inserted into at least an entrance of an ear canal of the user and the at least one conductive trace is disposed on the nozzle. The at least one conductive trace may include portions extending at least partially about a perimeter of the nozzle. The earbud may further include a conductive element disposed within the nozzle. The controller may be configured to detect changes in capacitance between the conductive element and the at least one conductive trace.

In some implementations, the earbud further comprises an insulator disposed on the at least one conductive trace.

The earbud may further include redundant conductive traces and the controller may be configured to calibrate the capacitive sensor based on a capacitance between the redundant conductive traces.

In some implementations, the at least one conductive trace is constructed and arranged to exhibit a capacitance that increase with a depth of insertion of the earbud in the ear of the user. The controller may be further configured to provide an indication of the depth of insertion of the earbud in the ear of the user. The controller may be further configured to provide feedback to the user of whether the earbud is inserted into the ear of the user.

In some implementations, the controller is further configured to differentiate between signals from the capacitive sensor indicative of insertion of the earbud in the ear of the user and signals from the capacitive sensor indicative of manual handling of the earbud.

In some implementations, the controller is further configured to cause the earbud to transition from an active state to an inactive state responsive to the capacitive sensor providing a signal indicative of the earbud being removed from the ear of the user.

In some implementations, the controller is further configured to cause the earbud to transition from an active state to an inactive state responsive to the capacitive sensor failing to providing a signal indicative of the earbud being inserted into the ear of the user after a set time after activation of the earbud.

In accordance with another aspect, there is provided a method of reducing power consumption of an earbud. The method comprises determining whether the earbud is inserted into an ear of a user based on a measurement of capacitance of one of at least one conductive trace disposed on the earbud relative to ground or different conductive traces disposed on the earbud relative to one another and causing the earbud to transition from an active state to an inactive state responsive to determining that the earbud is not inserted into the ear of the user for more than a threshold amount of time.

In some implementations, the method further comprises causing the earbud to transition from the active to the inactive state responsive to failing to determine that the earbud is inserted into the ear of the user after a set time after the earbud is placed into the active state.

In some implementations, the method further comprises causing the earbud to transition from the active to the inactive state responsive to determining that the earbud has transitioned from a state in which the earbud is inserted into the ear of the user to a state in which the earbud is not inserted into the ear of the user.

In some implementations, the method further comprises determining a degree of insertion of the earbud into the ear of the user from the measurement of capacitance. The method may further comprise providing feedback to the user regarding the depth of insertion of the earbud into the ear of the user through one of the earbud or a device in communication with the earbud.

In some implementations, the method further comprises determining a degree of seal of the earbud in the ear of the user from the measurement of capacitance. The method may further comprise instructing the user to reposition the earbud to achieve a better seal of the earbud in the ear of the user. The method may further comprise modifying noise cancelling functionality of the earbud based on the degree of seal.

In some implementations, the method further comprises detecting movement of the earbud within the ear of the user based on the measurement of capacitance.

In some implementations, the method further comprises calibrating a capacitance meter in electrical communication with the at least one conductive trace by setting a reference capacitance at a capacitance detected between redundant traces disposed on the earbud.

In some implementations, the at least one conductive trace is disposed on an outside of a nozzle of the earbud and the method comprises obtaining the measurement of capacitance readings by measuring capacitance between the at least one conductive trace and a conductive element disposed within the nozzle.

In accordance with another aspect, there is provided a method of detecting insertion of an earbud into an ear of a user. The method comprises measuring a capacitance of one of at least one conductive trace disposed on the earbud relative to ground or different conductive traces disposed on the earbud relative to one another and providing an indication of the earbud being inserted into the ear of the user responsive to the capacitance exceeding a threshold capacitance value.

In some implementations, measuring the capacitance comprises measuring the capacitance between a set of conductive traces disposed on a nozzle of the earbud.

In some implementations, measuring the capacitance comprises measuring the capacitance between a conductive trace disposed on a nozzle of the earbud and a conductive element disposed with the nozzle.

In accordance with another aspect, there is provided an earbud. The earbud comprises a nozzle configured to be inserted into at least an entrance of an ear canal of the user. At least a portion of the nozzle comprises a set of stacked washers. The washers comprise cores of insulating material and conductive material disposed on faces of the washers. The conductive material disposed on the faces of the washers forms a set of conductive traces. The earbud further includes a controller configured to provide an indication of the earbud being inserted into an ear of a user responsive to detecting changes in capacitance of one of at least one conductive trace relative to ground or different conductive traces relative to one another.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 1*a* is a perspective view of an example of in-ear audio device;

FIG. 1*b* is another perspective view of the example of the in-ear audio device of FIG. 1*a;*

DETAILED DESCRIPTION

Figure 2A:
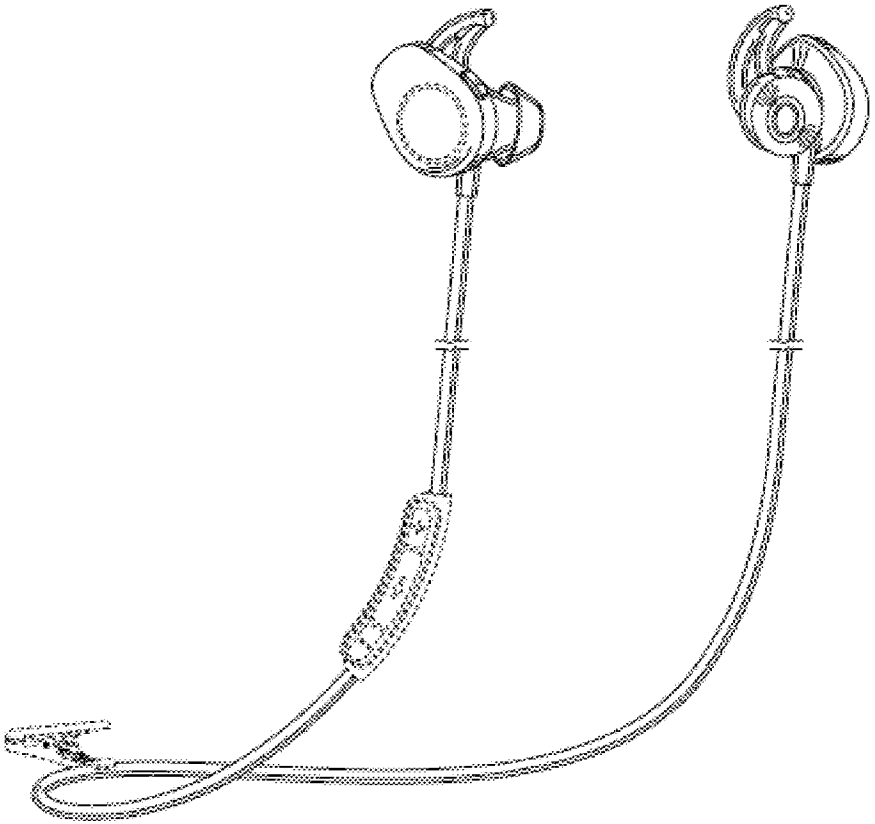
FIG. 2*a* is an isometric view of an in-ear audio device headset.

Aspects and implementations disclosed herein are not limited to the details of construction and the arrangement of components set forth in the following description or illustrated in the drawings. Aspects and implementations disclosed herein are capable of being practiced or of being carried out in various ways.

Aspects and implementations disclosed herein may be applicable to a wide variety of audio devices structured to be at least partly inserted into one or both ears of a user (e.g., so called "in-ear" audio devices or "intra-aural" audio devices), hereinafter referred to also as "wireless earbuds" or simply "earbuds," and audio players. The examples discussed herein are directed primarily to earbuds, which may be wired or wireless, but the technology disclosed may also have application to over-the-ear earphones or other audio devices. It should be noted that although specific implementations of wireless earbuds primarily serving the purpose of acoustically outputting audio are presented with some degree of detail, such presentations of specific implementations are intended to facilitate understanding through provision of examples, and should not be taken as limiting either the scope of disclosure or the scope of claim coverage.

Aspects and implementations disclosed herein may be applicable to earbuds that either do or do not support two-way communications, and either do or do not support active noise reduction (ANR). For earbuds that do support either two-way communications or ANR, it is intended that what is disclosed and claimed herein is applicable to an earbud incorporating one or more microphones disposed on a portion of the earbud that remains outside an ear when in use (e.g., feedforward microphones), on a portion that is inserted into a portion of an ear when in use (e.g., feedback microphones), or disposed on both of such portions. Still other implementations of earbuds to which what is disclosed and what is claimed herein is applicable will be apparent to those skilled in the art.

Various implementations and examples disclosed herein may provide for increased battery life in wireless earbuds by automatically causing the earbuds to turn off or deactivate when not in use. Further, various implementations and examples disclosed herein may provide for automatic control of audio playback in wired or wireless earbuds, for example to play audio when in use and pause audio when not in use. In some implementations, wireless earbuds are provided with one or more sensors that may be used to determine if the earbuds are inserted into the ear of a user. If a user removes an earbud from the ear of the user without first terminating rendering of audio by the earbud, the earbud may detect that it has been removed from the ear of the user and may automatically pause audio, or terminate rendering of audio and turn the earbud off, optionally after a set time after being removed from the ear of the user. In some implementations, if a user turns on an earbud and does not insert it into the ear of the user within a set time period, the earbud may automatically shut off.

In various implementations, earbuds may include one or more capacitive sensors. The one or more capacitive sensors may include conductive traces disposed on one or more portions of the wireless earbuds. The dielectric constant of the environment about the conductive traces is a factor that affects the capacitance between pairs of conductive traces or between the conductive traces and ground. The dielectric constant of human flesh is different than that of other materials or air and thus, as the conductive traces on an earbud are brought into proximity of the ear of a user, the capacitance between pairs of the conductive traces or between the conductive traces and ground changes. This change in capacitance may be detected by circuitry associated with the capacitive sensor or sensors. A degree of insertion of the earbud into the ear of a user may be determined by the capacitance between the conductive traces of the capacitive sensor or between the conductive traces and ground. Movement of the earbud into, out of, or from one position to another within the ear of the user may be determined by changes in capacitance between the conductive traces of the capacitive sensor or between the conductive traces and ground. The capacitive sensor may be calibrated to determine when an earbud is fully inserted into the ear of a user based upon measurements of capacitance between the conductive traces of the capacitive sensor or between the conductive traces and ground. Dummy or redundant conductive traces may be utilized to determine a baseline capacitance against which capacitance between the conductive traces or between the conductive traces and ground of the capacitive sensor used to detect insertion into the ear of the user may be compared to account for changes in moisture (e.g., sweat), eartips on the earbuds, or other environmental factors that may affect capacitance between the conductive traces or between the conductive traces and ground.

In some implementations, at least one conductive trace may be placed on a portion of an earbud that is designed to be inserted into the ear of a user during use, for example, an ear canal or nozzle portion of an earbud. Circuitry associated with the capacitive sensor may measure capacitance between one or multiple pairs of conductive traces or between at least one conductive trace and ground to determine, for example, whether the earbud is inserted into the ear of a user, if the earbud is fully inserted into the ear of the user, if the earbud forms an acceptable seal with the ear of the user, etc. In some implementations capacitance is measured between a conductive element disposed within or inside of the canal portion of the earbud and capacitive traces disposed on an external portion of the earbud, for example, the canal portion, in addition to, or as an alternative to measurements of capacitance between a pair or pairs of the conductive traces on the external portion of the earbud or between at least one of the conductive traces and ground.

In some implementations, acoustic processing circuitry associated with an earbud may modify one or more parameters of audio provided through the earbud based at least in part on a degree of fit or degree of insertion of the earbud into the ear of a user determined by the capacitance measurements made by the capacitive sensor. For example, the acoustic processing circuitry may modify one or more parameters of audio provided through the earbud to account for acoustic leakage associated with the earbud having a less than optimal degree of fit or insertion in the ear of the user. The one or more parameters of the audio may include, for example, volume or different equalization applied to different frequencies of audio rendered by the earbud.

Capacitive sensors in earbuds as disclosed herein may be used to manage battery life. The sensor could provide feedback on how well the earbud is seated in the ear canal of the user and adjust audio calibration accordingly.

The sensor output is specifically conducive to in-ear earbuds where it detects insertion inside the ear canal and not simply proximity to the ear. Detecting insertion of an earbud into an ear of a user rather than simply proximity of the earbud to the ear of the user is advantageous as it significantly reduces the pulse rate needed for detection to further improve battery life. An insertion detection method is an absolute threshold measurement that can be done infrequently.

FIGS. 1*a* and 1*b*, taken together, provide two views of one implementation of an earbud 100. FIGS. 1*a* and 1*b* are schematic representations of one possible earbud configuration. The ideas described herein apply to other configurations (for example, as shown in the additional figures included herein), so long as there is space (e.g., canal/nozzle portion) to put at least one conductive trace. The earbud 100 of FIGS. 1*a* and 1*b* has a casing made up of at least a canal portion 110 (also referred to herein as a nozzle portion) meant to be positioned within at least an entrance of an ear canal of a user's ear and a concha portion 120 meant to be positioned within at least a portion of the concha of the user's ear. More specifically, and as depicted, the concha portion 120 has a curved shape to fit within the concha of a user's ear while accommodating the shape of the concha as defined by portions of the tragus, anti-tragus, and anti-helix of the pinna of the ear. This curved configuration has a pair of extensions 122 and defines an inner periphery 123. The canal portion 110 has a generally tubular shape extending from where one end of the canal portion 110 is coupled to the concha portion 120 at a location coincident with where the entrance to the ear canal is typically located in relation to the portion of the concha defined by portions of the tragus and anti-tragus. An aperture 118 is formed in the other end of the canal portion 110 to enable sounds to be acoustically output by an acoustic driver (e.g., element 190 illustrated in FIG. 3*a*) positioned within the casing of the earbud 100 through the aperture 118 and into the ear canal when the earbud 100 is properly positioned in the ear of a user during operation.

The implementation of the earbuds 100 depicted in FIGS. 1*a* and 1*b* may be any of a variety of types of earbuds able to perform any of a variety of audio functions including, and not limited to, an in-ear earphone to acoustically output audio, an in-ear ANR device to provide a reduction in environmental noise sounds encountered by a user through the acoustic output of anti-noise sounds, and/or a two-way communications audio device employing detection of the user's speech sounds through bone conduction and/or an Eustachian tube connected to portions of the ear into which the in-ear audio device 100 is inserted. Further, it should be noted that although the concha portion 120 has been depicted and described as having a curved shape to fit within the concha, other implementations are possible having a somewhat differently shaped concha portion 120 that does not fill as much of the concha, or fills more of the concha.

The earbud 100 may receive audio through a wired or wireless coupling with another device. Accordingly, electrical and electronic components such as, but not limited to, a wireless receiver and/or transmitter, processor (optionally including ANR circuitry), battery, microphone, and acoustic driver may be included within the concha portion 120 and/or canal portion 110 of the earbud 100. Alternatively, such components may be included within a housing or casing coupled to the earbud.

Figure 2B:
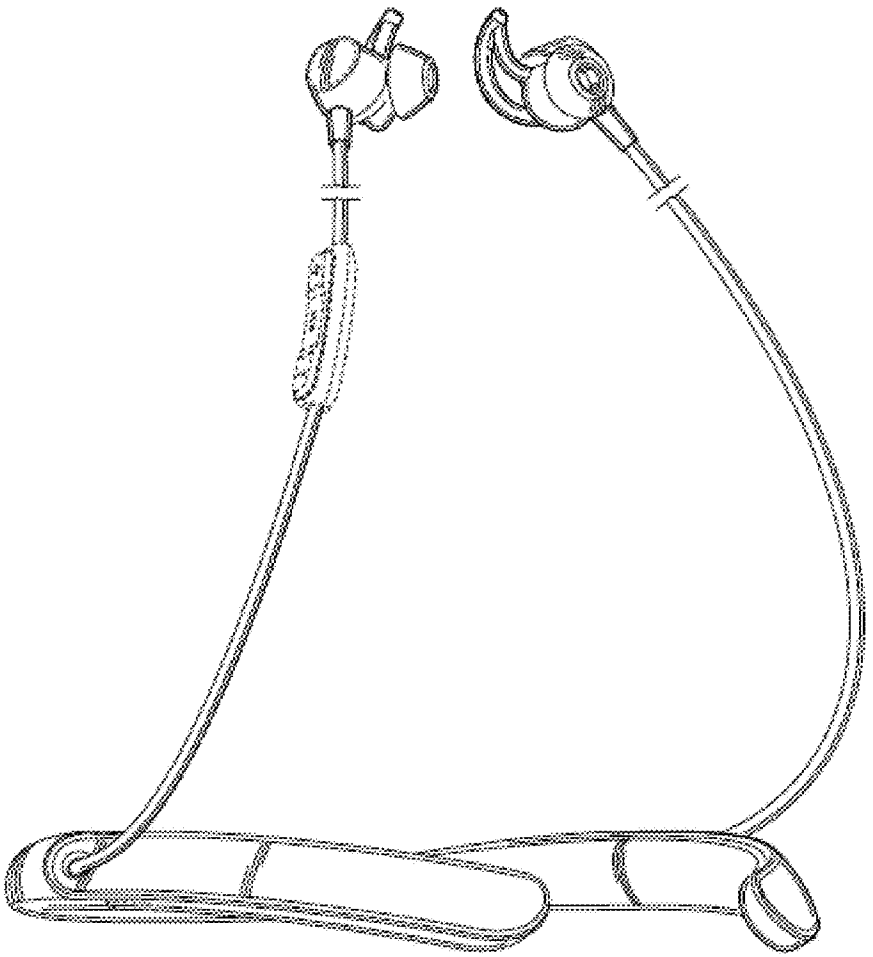
FIG. 2*b* is an isometric view of another in-ear audio device headset.
Figure 2C:
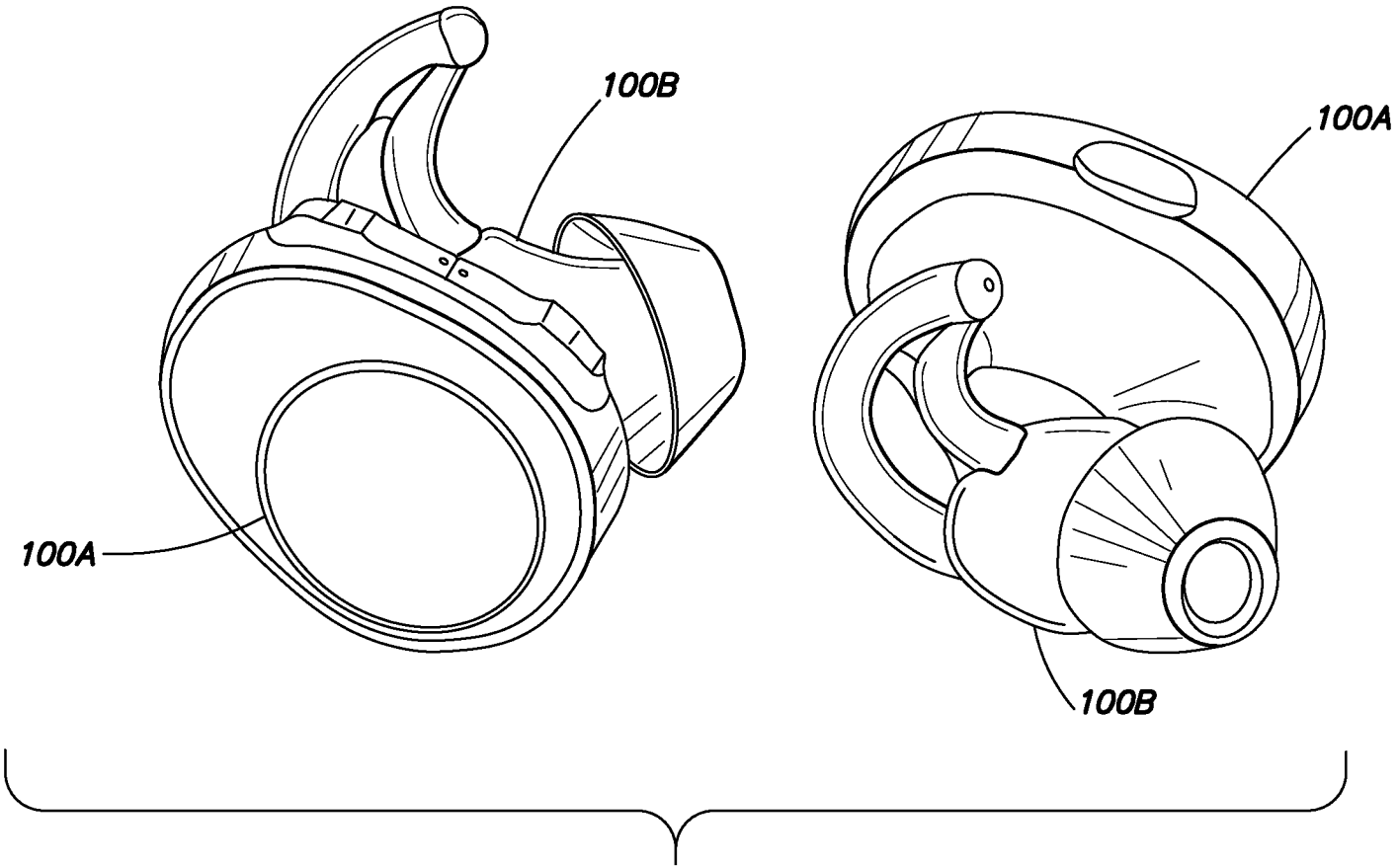
FIG. 2*c* illustrates an example of a pair of wireless in-ear audio devices.

Examples of earbuds 100 disclosed herein are not limited to the form factors illustrated in FIGS. 1*a* and 1*b*. Other examples of form factors for earbuds are illustrated in FIGS. 2*a*-2*d*. The earbuds may be coupled by wiring as illustrated in FIGS. 2*a* and 2*b* to form headsets or may be mechanically separate, as illustrated in FIG. 2*c*. In various examples, the canal portion 110 or eartip may be separable from the concha portion 120 or may include a removable covering made of, for example, soft silicone to enhance comfort for a user. For example, in FIG. 2*c*, section 100A may include a rigid shell housing electronics such as an acoustic driver, wireless communication circuitry, battery, etc., while section 100B may be a removable eartip formed of a soft compliant material, for example, medical grade silicone.

Figure 2D:
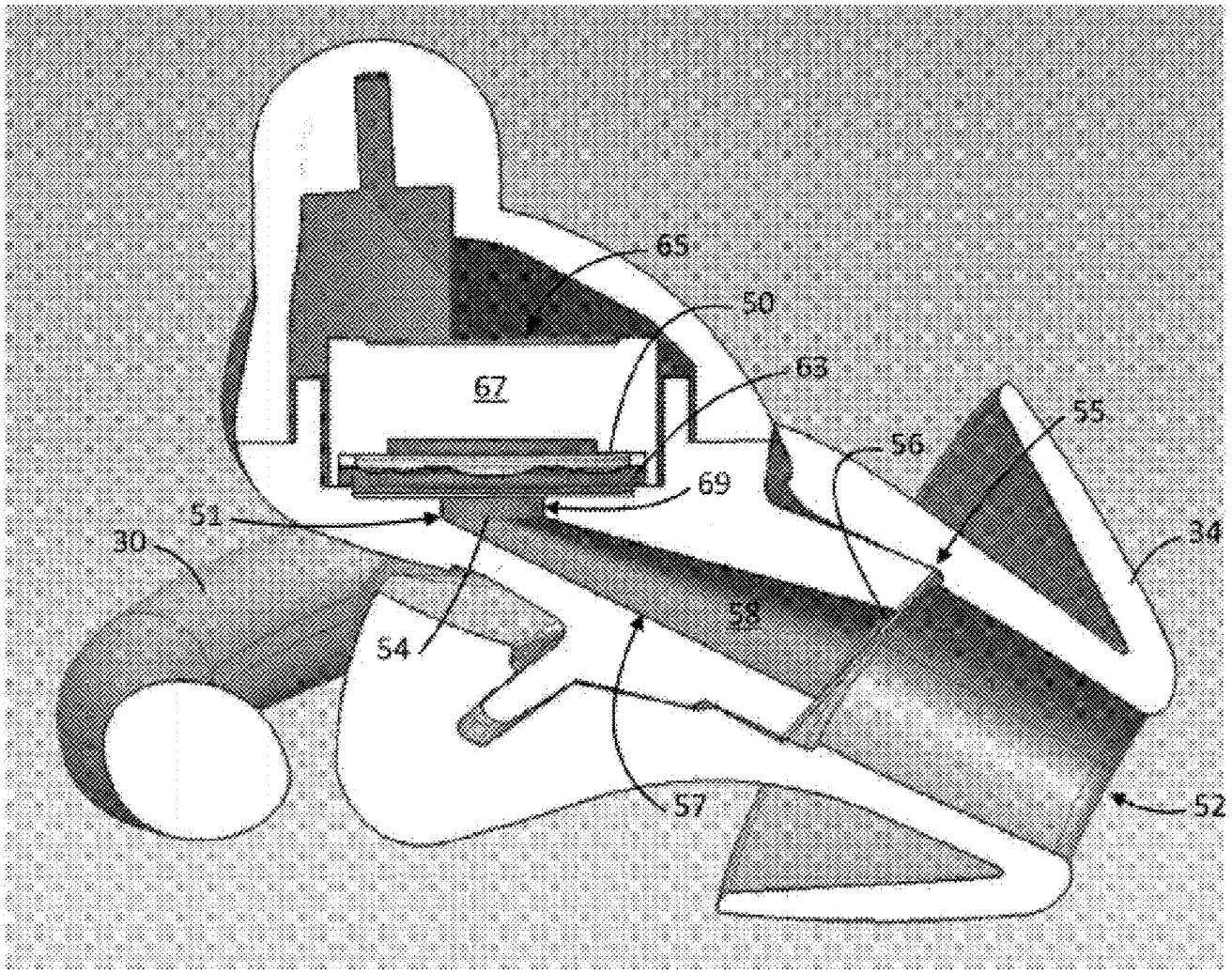
FIG. 2*d* is a perspective view in partial cross section of an example earpiece.

Examples of earbuds 100 disclosed herein may have cross-sections similar to that illustrated in FIG. 2*d*. In the example illustrated in FIG. 2*d* an outer leg 30 may extend from the body of the earbud, similar to concha portion 120 in FIGS. 1*a* and 1*b* to retain the earbud in the ear of a user. A sealing structure 34 is provided to engage the entrance to the user's ear canal and defines an output aperture 52. An entrance cavity 69 to an acoustic nozzle 57 having an interior volume 58 may be provided proximal to an acoustic driver 50. Driver 50 is enclosed in a driver cavity 65 including a front cavity 63 having a first volume and a back cavity 67 having a second volume. An entrance cavity 69 may be formed in front of driver cavity 63 that transitions to an entrance aperture 51 of the nozzle 57. In the implementation shown in FIG. 2*d*, the output aperture 55 of nozzle 57 is significantly larger than the entrance aperture 51. A first acoustic mesh 54 is provided at the entrance aperture 51 of the acoustic nozzle proximate the acoustic driver 50, and a second acoustic mesh 56 is provided at the output aperture of the acoustic nozzle 57 distal from acoustic driver 50

Figure 3B:
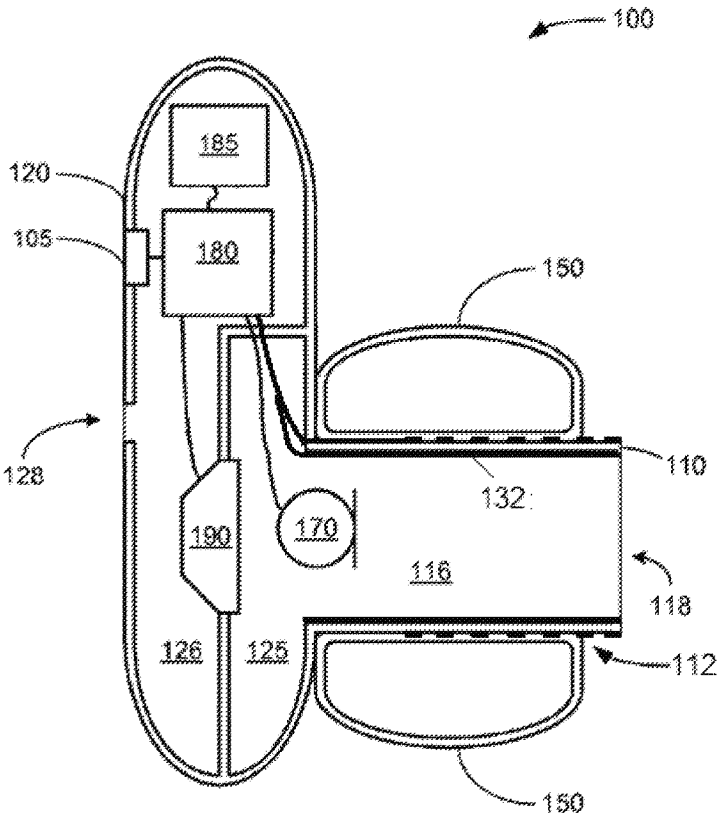
FIG. 3*b* is a partially cutaway view of another example of an in-ear audio device including a capacitive ear insertion sensor.
Figure 3A:
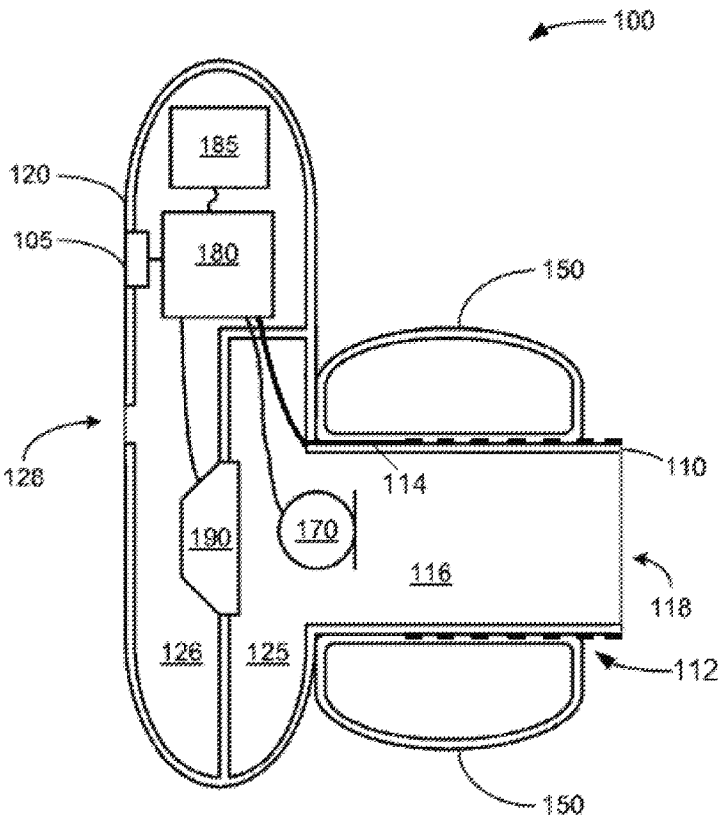
FIG. 3*a* is a partially cutaway view of the example of an in-ear audio device including a capacitive ear insertion sensor.
Figure 3C:
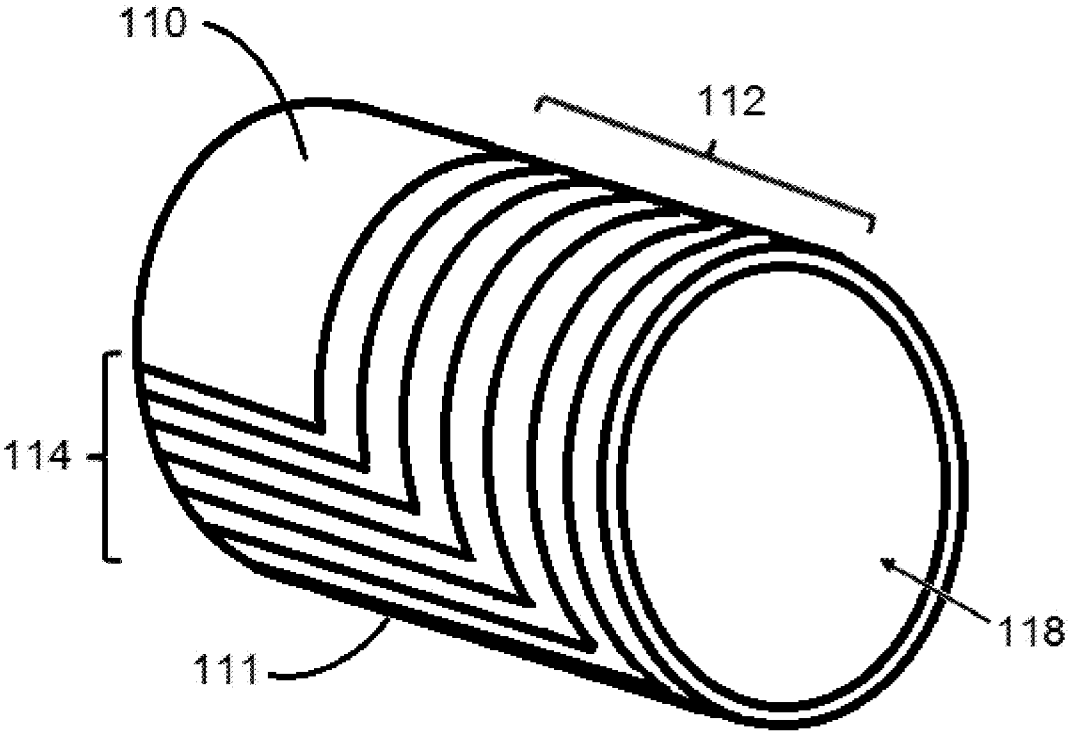
FIG. 3*c* illustrates an example of conductive traces of a capacitive sensor disposed on a canal portion of an in-ear audio device.

FIGS. 3*a* and 3*b* show partially cut-away views of two different variants of an earbud 100 including sensor systems for determining if the earbud 100 is inserted into the ear of a user. It is to be understood that the form factor illustrated in FIGS. 3*a* and 3*b* is not limiting, and earbud 100 may alternatively have any of the form factors illustrated in FIGS. 1*a*-2*e* or other form factors known in the art. The sensor systems may include at least one conductive trace 112 disposed on a portion of the earbud 100, for example, the outside of the canal portion 110. As illustrated in FIG. 3*c*, the conductive traces 112 may extend at least partially or substantially wholly about a periphery of the outer surface of the canal portion 110. Connective traces 114 provide electrical communication between the conductive traces 112 and control/monitor circuitry 180 of the earbud 100. The conductive traces 112 may have widths of about 10 mils (0.254 mm), thicknesses of between about 1 mil (0.0254 mm) and 10 mils, and may be separated by about 10 mils, although these dimensions are non-limiting examples. The connective traces 114 may have similar dimensions as the conductive traces 112. The conductive traces 112 and/or connective traces 114 may be formed of, for example, metal film or other conductive material and may be deposited on the earbud 100 using methods known in the art, for example, using methods similar to those for depositing conductive traces on printed circuit boards.

Conductive traces 112 that are closer to the concha portion 120 of the earbud 100 than the aperture 118 of the canal portion 110 may extend about the periphery of the canal portion 110 to a lesser degree than conductive traces 112 located closer to the aperture 118 of the canal portion 110 to allow room for the connective traces 114 associated with each individual conductive trace 112 to extend along a length of the canal portion 110. A conductive trace 112 closest to the aperture 118 of the canal portion 110 among all of the conductive traces 112 may extend completely about the periphery of the canal portion 110. Alternatively or additionally, insulating material, for example, a thin film of insulting plastic 111 may be provided over the conductive traces 112 and/or between connective traces 114 to prevent short circuits between the conductive traces 112 and/or connective traces 114 or to provide for the connective traces 114 to overlap so that the conductive traces 112 may each extend substantially or completely about the periphery of the canal portion 110 of the earbud 100.

Figure 3D:
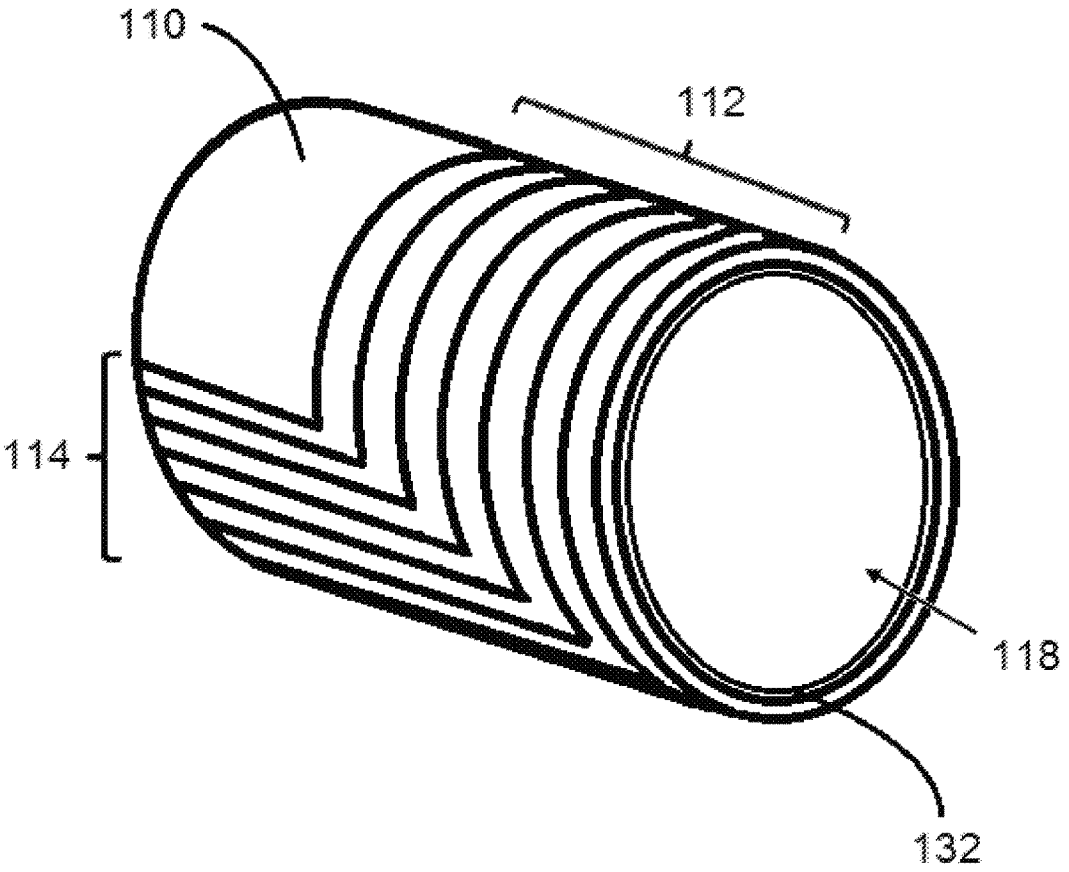
FIG. 3*d* illustrates another example of conductive traces of a capacitive sensor disposed on a canal portion of an in-ear audio device.
Figure 3E:
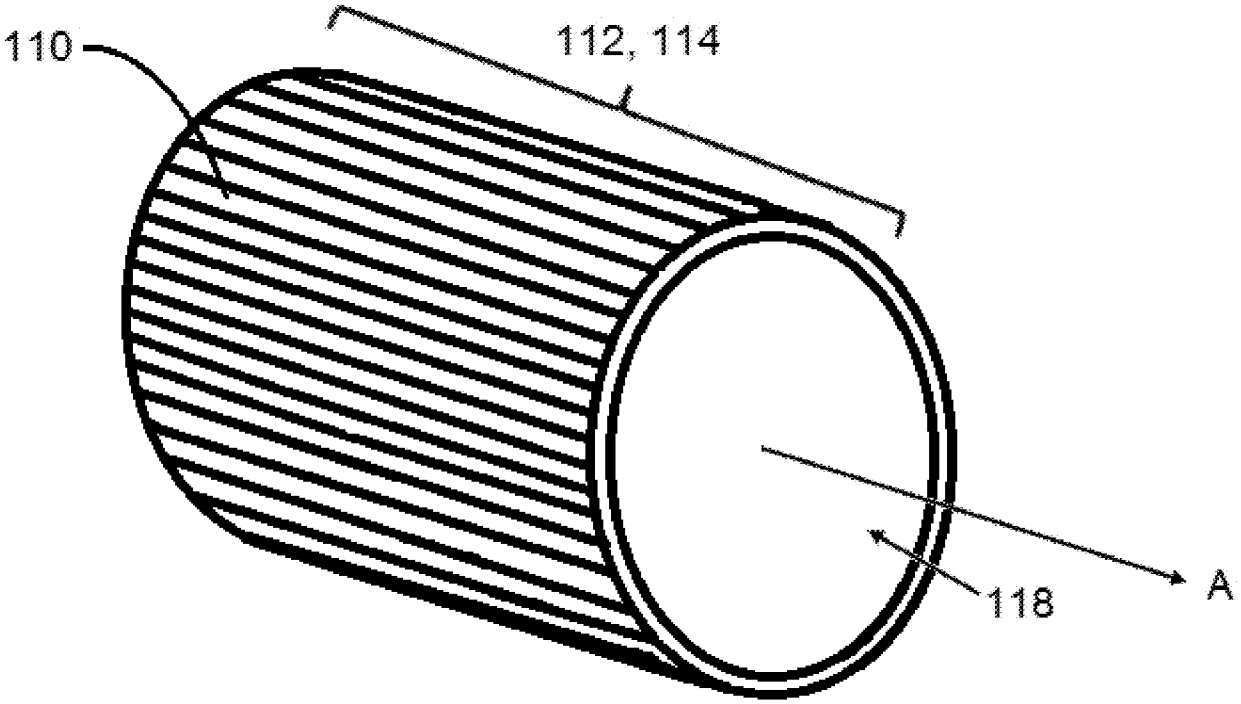
FIG. 3*e* illustrates another example of conductive traces of a capacitive sensor disposed on a canal portion of an in-ear audio device.

As described more fully below, the control/monitor circuitry 180 of the earbud 100 is configured to measure capacitance between different pairs of conductive traces 112 or between at least one conductive trace 112 and ground to determine if the earbud is inserted properly into the ear of a user and/or provides an acceptable fit and seal in the ear of the user. In other examples, one or more internal conductive traces or a conductive coating 132, illustrated in FIGS. 3*b* and 3*d*, may be disposed within at least a portion of the canal portion 110 of the earbud 100, for example, on an internal surface of the canal portion 110 of the earbud 100. In implementations in which such internal conductive traces or conductive coating 132 are present the control or monitor circuitry 180 of the earbud 100 may additionally or alternatively be configured to measure capacitance between at least one or different conductive traces 112 and the internal conductive traces or conductive coating 132 to determine if the earbud is inserted properly into the ear of a user and/or provides a good fit and seal in the ear of the user. In a further example illustrated in FIG. 3*e*, the conductive traces 112 may be combined with the connective traces 114 and may extend along the outside (and/or the inside) of canal portion 110 substantially parallel with an axis A of the canal portion 110. The skilled artisan will recognize that other configurations and arrangements of the conductive traces 112 and/or connective traces 114 may be implemented in other examples. For example, the conductive traces 112 and/or connective traces 114 may extend helically around or inside the canal portion 110 of the earbud 100. The number of conductive traces 112 and connective traces 114 illustrated is not intended to be limiting and other examples of earbuds may include fewer or greater number of conductive traces 112 and/or connective traces 114 than illustrated.

Figure 3F:
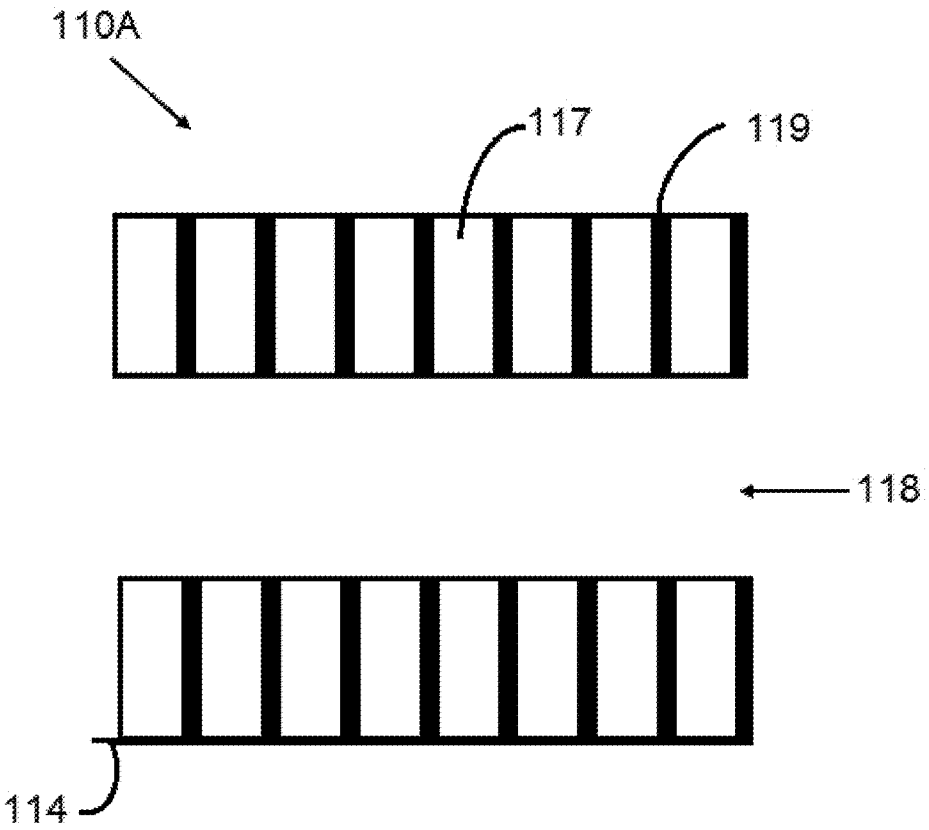
FIG. 3*f* is a cross-section of an example of a canal portion of an in-ear audio device formed from stacked washers.

In another implementation, illustrated in FIG. 3*f*, a canal portion 110A of the earbud 100 may be formed from a plurality of stacked washers 117. The bodies of the washers 117 may be formed of a non-conducive material, for example, a type of plastic commonly used to form the bodies or canal portions of earbuds. Conductive material 119, for example, a metal film disposed on or within faces of the washers 117 may perform the function of the conductive traces 112 described with reference to the other examples disclosed herein. Connective traces 114 may provide electrical connection between the different layers of conductive material 119 and the monitor or control circuitry of the earbud similar to how the connective traces 114 provide electrical connection to the circuitry 180 as illustrated in, for example, FIGS. 3*a* and 3*c*.

In some implementations, one or more pairs of conductive traces 112 (which may be referred to as dummy or redundant conductive traces) may be utilized to measure a baseline capacitance against which the capacitance between other conductive traces 112 or between at least one conductive trace 112 and ground (and/or between at least one conductive trace 112 and internal conductive traces or conductive coating 132) may be compared to obtain capacitance measurements used to determine if the earbud is inserted properly into the ear of a user and/or provides an acceptable fit and seal in the ear of the user. This baseline capacitance may change based on changes that occur to the ear of the user, for example, after exercise when the blood vessels of the ear may be more open and the inside of the ear may include sweat or during cold weather during which the blood vessels in the ear may contract. The baseline capacitance may also change if a user switches between different types of removable eartips on the canal portion of the earbud 100. Other changes in the physical condition of a user can also bring about minor alterations in the dimensions and/or shape of the ear canal that may alter a baseline capacitance of between conductive traces 112. The capacitance between the active (non-dummy or redundant) conductive traces 112 or between at least one conductive trace 112 and ground (or between at least one conductive trace 112 and internal conductive traces or conductive coating 132) may be compared against the baseline capacitance so that changes in the baseline capacitance do not cause the monitoring circuitry 180 of the earbud to derive incorrect conclusions regarding the degree of insertion or fit of the earbud in the ear of the user based on uncompensated capacitance measurements between the active conductive traces 112 or between at least one conductive trace 112 and ground. In some examples, the dummy or redundant conductive traces 112 are dedicated to providing baseline capacitive measurements, but in other examples, control circuitry of the earbud may periodically switch the functionality of the dummy or redundant conductive traces 112 from providing baseline capacitance measurements to providing capacitive measurements used to determine the degree of insertion or fit of the earbud in the ear of the user.

Figure 4A:
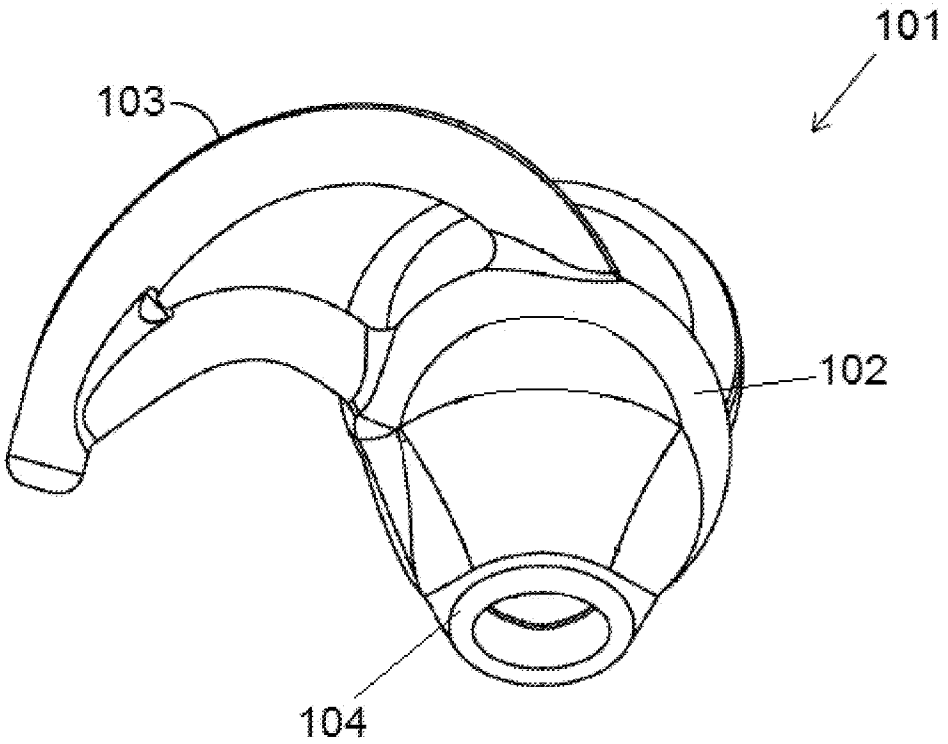
FIG. 4*a* is an example of an eartip that may be utilized with various examples of in-ear audio devices disclosed herein.
Figure 4B:
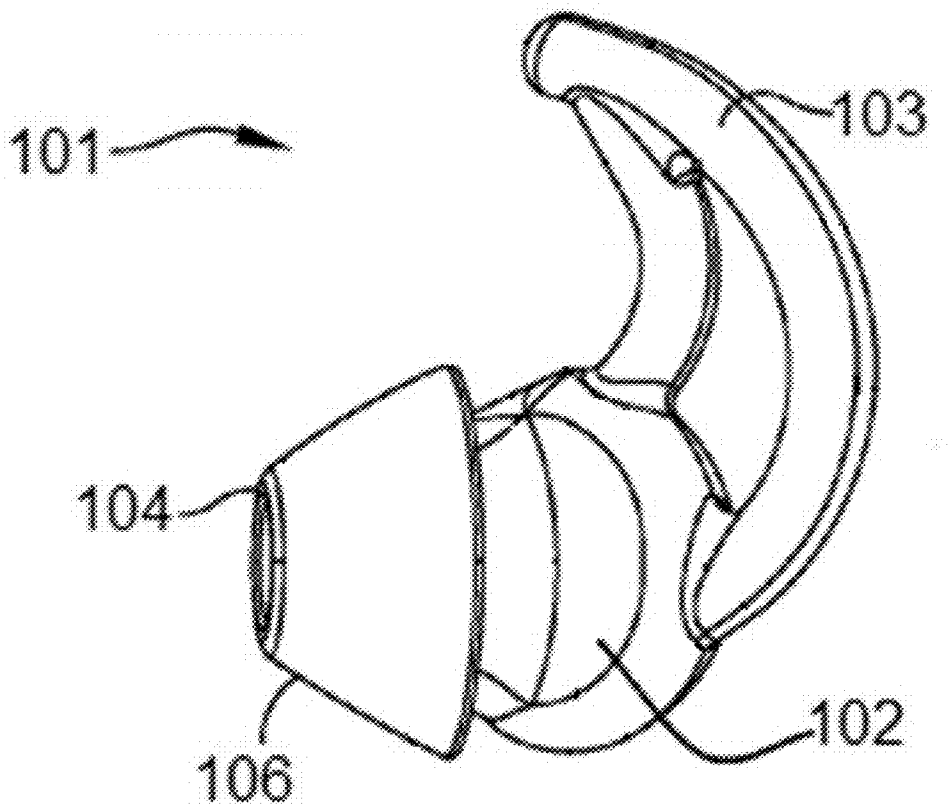
FIG. 4*b* is another example of an eartip that may be utilized with various examples of in-ear audio devices disclosed herein.

The eartips of the earbuds 100 illustrated in FIGS. 3*a* and 3*b* are represented by elements 150. Alternate examples of eartips, which may be removable ear tips that may be used with examples of earbuds disclosed herein, are illustrated in FIGS. 4*a* and 4*b*, indicated generally at 101. These ear tips 101 have a configuration that includes a body 102 that rests in at least a part of the concha, a retaining leg 103 that rests against and applies pressure to the antihelix, and an outlet 104 that fits within at least an entrance in the ear canal. The ear tip 101 illustrated in FIG. 4*b* further includes a flexible flap 106 around the outlet. The construction and configuration of the removable ear tips 101 illustrated in FIGS. 4*a* and 4*b* are described in further detail in commonly owned U.S. Pat. Nos. 8,311,253 and 8,737,669, which are incorporated by reference in their entirety herein.

Both variants of the earbud 100 illustrated in FIGS. 3*a* and 3*b* may incorporate circuitry 180 and an acoustic driver 190 that is electrically coupled to the circuitry 180. Within the canal portion 110, a channel 116 is formed that extends from the aperture 118 through to an interior portion 125 of the concha portion 120. Within the concha portion 120, the interior portion 125 is separated by a wall structure and the acoustic driver 190 from another interior portion 126 in which the circuitry 180 is depicted as being disposed (though it should be noted that the circuitry 180 may be disposed in any of a variety of locations either within the casing of the earbud 100, or externally thereof). The earbuds 100 further include a battery 185 to power the various components and wireless communication circuitry built into the circuitry 180 or a separate circuit element (though this may also be located in a housing separate from earbud 100). The earbud 100 may also include a microphone 170 that is acoustically coupled to the channel 116 and/or the interior portion 125 and electrically coupled to the circuitry 180 for providing two-way communications through the earbud 100 or feedback-based ANR. Optionally, the earbud 100 may be activated or deactivated with a manually operable power switch 105.

Both of the variants of FIGS. 3*a* and 3*b* are depicted as having an aperture 128 formed between the interior portion 126 and the environment external to a user's ear. One or more of the apertures 128 may serve as acoustic ports to tune the frequency response of the acoustic driver 190 and/or may serve to enable equalization of air pressure between the ear canal and the external environment. The apertures 128 may have dimensions and/or other physical characteristics selected to acoustically couple portions within the casing of the earbud 100 to each other and/or to the external environment within a selected range of frequencies. Further, one or more damping elements (not shown), for example, a screen or foam insert, may be disposed within one or more of the apertures 128 to cooperate with characteristics of the acoustic driver 190 to alter frequency response.

Additionally or alternatively, one or more of the apertures 128 may be formed in the concha portion 120 (and/or in other portions of the casing) to provide a controlled acoustic leak between the ear canal and the external environmental for purposes of controlling the effects of variations in fit that may develop over time. As will be recognized by those skilled in the art, variations in the health or other aspects of the physical condition of a user can bring about minor alterations in the dimensions and/or shape of the ear canal over time such that the quality of the seal able to be formed with each insertion of the earbud 100 into the ear over time may change. Thus, in some implementations, the dimensions and/or other characteristics of one or more apertures 128 formed in the casing may be selected to aid in mitigating the effects of a slightly degraded quality of seal by providing a pre-existing leak of controlled characteristics that mitigates the acoustic effects of other leaks developing in the future in the seal between the casing of the earbud 100 and portions of the ear. For example, the dimensions of one or more apertures 128 may be selected to be large enough to provide a far greater coupling between the ear canal and the external environment than any other coupling through a leak in the seal that may develop at a later time.

The conductive traces 112 and/or internal conductive traces or conductive coating 132 may be electrically coupled to the circuitry 180. Various of the conductive traces 112 and/or internal conductive traces or conductive coating 132 may receive drive signals from the circuitry 180. Measurements of capacitance between pairs of conductive traces 112 or between at least one conductive trace 112 and ground (and/or internal conductive traces or conductive coating 132) may be obtained from electrical measurements (e.g., voltage potential) taken from undriven conductive traces 112 by the circuitry 180. In various implementations, either a dedicated controller, or part of a System on Chip integrated circuit, may be used to determine the capacitance between pairs of conductive traces 112 (and/or internal conductive traces or conductive coating 132). One example of a controller that may be used to determine the capacitance between pairs of conductive traces 112 (and/or internal conductive traces or conductive coating 132) to determine the relative position of the sensing electrodes with respect to the ear canal is a Cypress PSoC 4000S series controller with built-in capacitance sensing.

When the earbud 100 is not inserted into the ear of a user, capacitance between different pairs of conductive traces 112 or between at least one conductive trace 112 and ground (and/or internal conductive traces or conductive coating 132) may be at a first level defined by factors such as geometry of the conductive traces and the dielectric constant of the medium surrounding the conductive traces, e.g., air. When the earbud 100 is inserted into the ear of a user, the dielectric constant of the flesh of the ear canal causes the capacitance between pairs of conductive traces 112 or between at least one conductive trace 112 and ground to change, for example, to increase, thus providing an indication that the earbud 100 is inserted into the ear of the user. As a user inserts the earbud 100 into the ear of the user capacitance between conductive traces 112 closer to the aperture 118 end of the canal portion 110 change before capacitance between conductive traces 112 closer to the concha 120 end of the canal portion 110 change. The circuitry 180 may detect this pattern of capacitance changes to determine that the earbud 100 is being inserted into the ear of the user. The extent to which the capacitance between different pairs of conductive traces 112 changes may provide an indication of the degree of insertion of the earbud into the ear of the user. In some examples, the earbud may provide the user with an indication of the depth of insertion of the earbud in the ear of the user, for example, by the circuitry 180 causing the acoustic driver 190 to emit sound pulses or tones that vary depending on a degree of insertion of the earbud into the ear of the user. In other examples, the earbud could emit a signal when the insertion reaches an optimal point, for example, a point at which the earbud is fully inserted into the ear of the user. As the earbud is removed from the ear of the user, the opposite pattern may be observed—for example, capacitance between conductive traces 112 closer to the concha 120 end of the canal portion 110 change before capacitance between conductive traces 112 closer to the aperture 118 end of the canal portion 110 change. The circuitry 180 may detect this pattern of capacitance changes to determine that the earbud 100 is being removed from the ear of the user and in some examples may provide an indication of same to the user, for example, by providing an audio tone or pattern through the acoustic driver 190 that varies depending on a degree of insertion of the earbud into the ear of the user. Indications may also be provided via a user interface of an application running on a device connected to the earbud wirelessly. In some examples, the earbud may automatically shut down responsive to detecting a pattern of capacitance changes indicative of the earbud having been removed from the ear of the user.

In some implementations, the circuitry 180 may be configured to differentiate between a pattern of capacitance changes between pairs of conductive traces 112 or between at least one conductive trace 112 and ground that would be observed when inserting or removing the earbud 100 from the ear of the user and a pattern of capacitance changes between pairs of conductive traces 112 or between at least one conductive trace 112 and ground that would be observed when a user is manually handling the earbud 100. For example, as described above the capacitance between pairs of conductive traces 112 or between at least one conductive trace 112 and ground may change in a predictable pattern as the earbud 100 is inserted or removed from the ear of the user. A different pattern of observed changes in capacitance between pairs of conductive traces 112 or between at least one conductive trace 112 and ground may be recognized by the circuitry 180 as being indicative of manual handling of the earbud 100 and may be ignored with regard to determining a degree of insertion of the earbud 100 in the ear of the user.

In some examples, once the earbud 100 has been fully inserted into the ear of the user, the measured capacitance between different conductive traces or between at least one conductive trace and ground may provide an indication of a degree of fit of the earbud in the ear of the user. For example, if the capacitance between certain pairs of conductive traces 112 or between at least one conductive trace 112 and ground is different, e.g., less than would be expected if a proper fit were achieved, the circuitry may determine that the earbud is not properly inserted and may provide an indication of same to the user, for example, by emitting a tone or other sound pattern, or via a user interface of an application running on a device connected to the earbud wirelessly. Such a tone, sound pattern, or user interface output may be considered instructions from the circuitry to the user to reposition the earbud 100 into a more proper position in the ear of the user. If the measured capacitance levels are consistent with the earbud 100 being properly inserted into the ear of the user, the circuitry 180 may cause the earbud to emit a tone or beep or provide another indication of proper insertion to the user. In both instances, the earbud could additionally or alternatively emit an audio message, such as "the ear bud is not fully inserted" or "the ear bud is properly inserted." In another example, if the measured capacitance between different pairs of conductive traces 112 or between at least one conductive trace 112 and ground is not steady, this may indicate that the earbud 100 is loose in the ear of the user. The circuitry may provide an indication to the user that the earbud 100 is loose so that the user might, for example, reinsert the earbud or try a different removable eartip that may provide a better degree of fit in the ear of the user.

Figure 5:
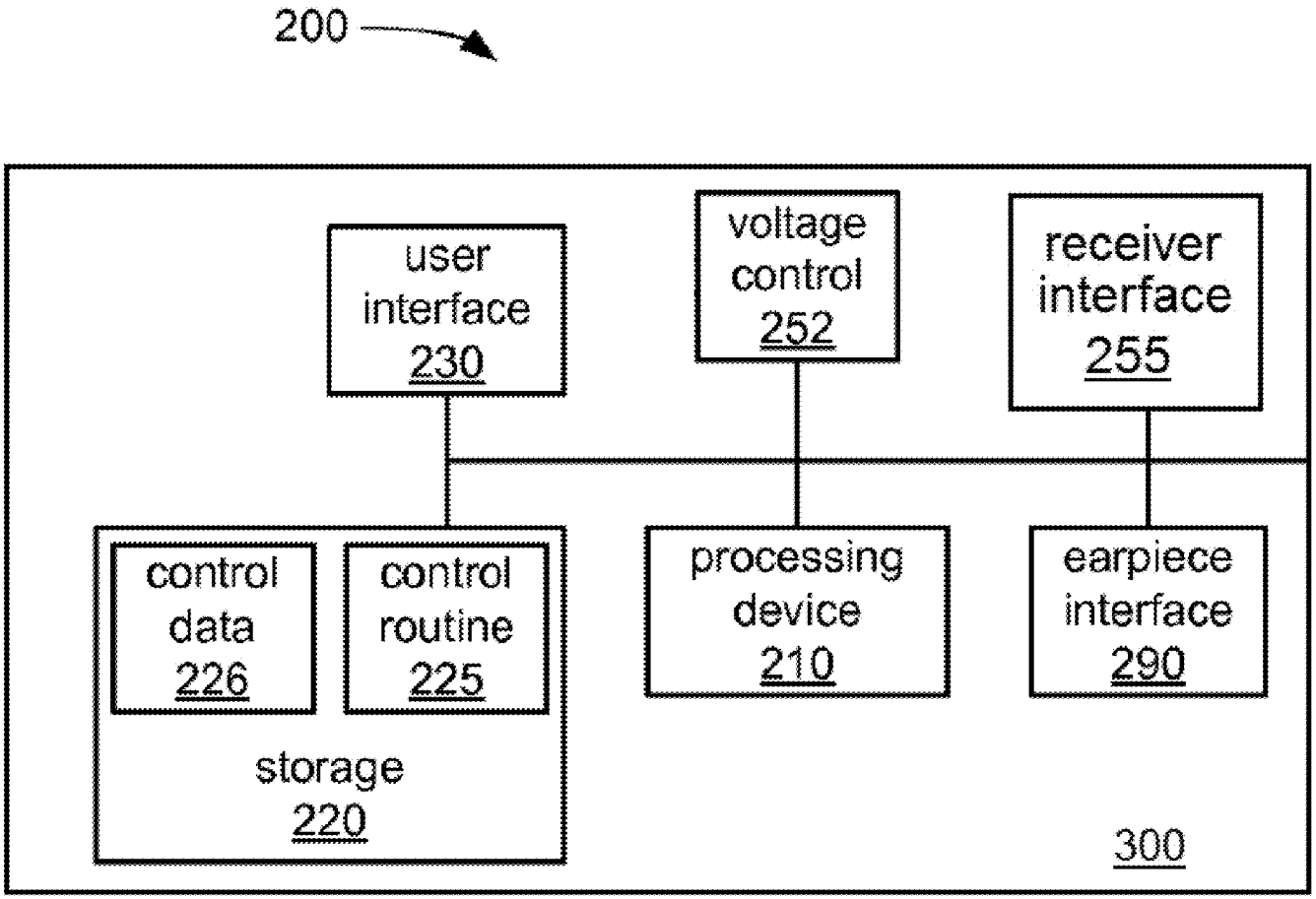
FIG. 5 is a block diagram of an example of a controller for an in-ear audio device.

FIG. 5 provides a block diagram of a controller 200 with which insertion of an earbud as disclosed herein within an ear of a user may be detected. The controller 200 may be included within the body of an earbud, for example, within circuitry 180. The controller may be formed on a circuit board 300. Each earbud in a pair of earbuds may include a controller 200, or a single controller 200 may control operation of both earbuds in a pair and may communicate via a wired or wireless connection between the two earbuds in the pair.

The controller 200 incorporates a voltage control 252 to controllably provide a driving voltage to one or more conductive traces 112 disposed on or in the canal portion 110 of an earbud 100. The controller 200 also incorporates a user interface 230 which may wirelessly communicate with an external system, for example, a cell phone or computer, for receiving programming or providing recorded information, a storage 220 in which is stored a control routine 225 and control data 226, and a processing device 210 coupled to the storage 220 to access and execute a sequence of instructions of the control routine 225. The processing device 210 is also coupled to the voltage control 252 to operate the voltage control 252 to effect the application of a controlled voltage to the one or more of the conductive traces 112 and is further coupled to the receiver interface 255 which receives signals from one or more receiving conductive traces 112 disposed on or in the canal portion of an earbud 100. The controller 200 also incorporates at least an earpiece interface 290 to enable coupling of the controller 200 to the built-in microphone 170 and the acoustic driver 190 to be driven to acoustically output various test sounds that may be used to help calibrate the determination of insertion of earbuds in the ear of a user by the controller 200. In some implementations separate voltage controllers 252 are provided for each driven conductive trace 112 in an earbud or pair of earbuds, and in other implementations, a single voltage controller 252 is used with each driven conductive trace in an earbud or pair of earbuds. Similarly, in some implementations separate receiver interfaces 255 are provided for each receiving conductive trace 112 in an earbud or pair of earbuds, and in other implementations, a single receiver interface 255 is used with each receiving conductive trace 112 in an earbud or pair of earbuds.

Figure 6:
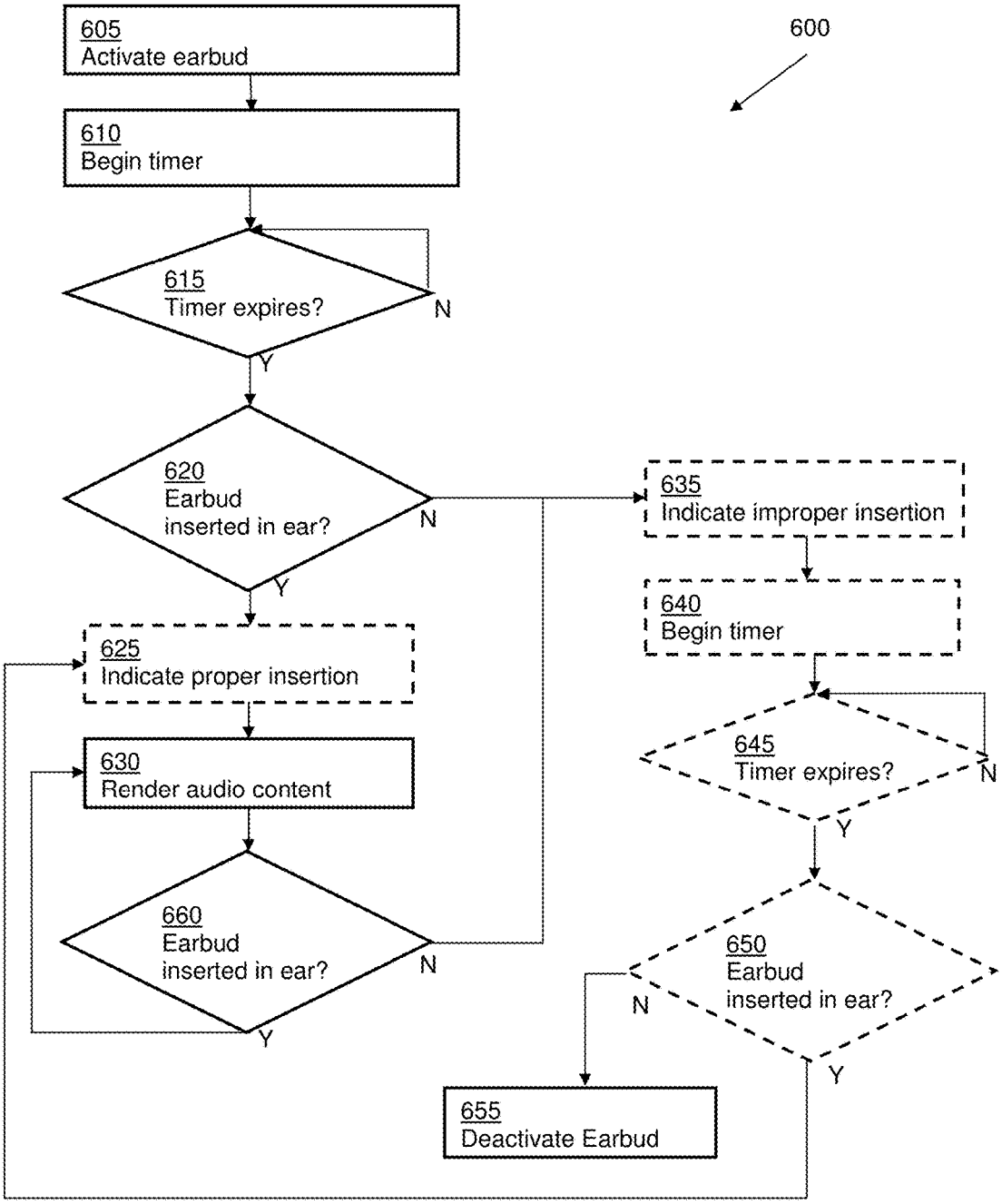
FIG. 6 is a flow chart of a method for using examples of in-ear audio devices disclosed herein.

An implementation of a method of operating an earbud 100 with a capacitive earbud insertion sensor as shown in FIG. 3*a* is illustrated in the flowchart of FIG. 6, indicated generally at 600. In act 605 a user activates the earbud. The user may activate the earbud by pressing a power switch. Additionally or alternatively, the earbud may include an accelerometer, for example, a microelectromechanical accelerometer built into the circuitry of the earbud that detects movement of the earbud and may activate the earbud when a user picks up the earbud. Further, the earbud may activate when the capacitive sensor detects changes in capacitance between conductive traces or between at least one conductive trace and ground indicative of manual handling of the earbud. Activation of the earbud may cause a timer to begin counting down (acts 610, 615). Upon expiration of the timer (act 615) the earbud controller may determine whether a signal from driven capacitive traces being received at receiving conductive traces or a capacitance between at least one conductive trace and ground is consistent with the at least one conductive trace or conductive traces being located in the ear canal of the user to determine if the earbud is inserted into the ear of the user (act 620). In some embodiments, the earbud controller determines that the earbud is inserted into the ear of the user if a signal from the receiving conductive traces or between at least one conductive trace and ground was indicative of the capacitance between the driven and receiving conductive traces or between at least one conductive trace and ground having increased over a period of time from a first time to a second time. A threshold amount of capacitance change, for example, at least about 90% or at least about 75% change in capacitance as compared to an expected change in capacitance may be set for determining if the earbud is inserted into the ear of the user.

If the earbud was determined to be properly inserted in the ear of the user in decision act 620, the earbud may optionally provide an indication of proper insertion being detected, for example, by emitting a click or a tone (act 625) and the earbud may begin to render audio content (act 630). In some embodiments, the earbud need not wait for the timer to expire but may continuously check for proper insertion of the earbud after the earbud is activated and may provide an indication of proper insertion being detected and begin to render audio any time prior to expiration of the timer.

If the earbud was not determined to be properly inserted in the ear of the user in decision act 620 or prior to expiration of the timer, the earbud may optionally provide an indication of improper insertion (act 635), for example, a pattern of clicks or a tone different from that used to provide an indication of proper insertion of the earbud in the ear of the user. The earbud may then begin and await expiration of a second timer (acts 640, 645) and if the earbud is not determined to be properly inserted in the ear of the user prior to or at the time of expiration of the second timer (act 650), the earbud controller may deactivate the earbud (act 655). If, however, in decision act 650 the earbud controller determines that the earbud is properly inserted into the ear of the user it may optionally provide an indication of proper insertion being detected, for example, by emitting a click or a tone (act 625) and the earbud may begin to render audio content (act 630).

Periodically, for example, at a rate of between about 1 second, 5 seconds, 10 seconds, 30 seconds, 1 minute or 5 minutes, the earbud may recheck if it is still inserted into the ear of the user (act 660). In addition, or alternatively, upon detection of an event, for example, detecting movement of the earbud via an accelerometer built into the earbud, the earbud may recheck if it is still inserted into the ear of the user (act 660). If the earbud is still inserted into the ear of the user the earbud may continue rendering audio content. If in decision act 660 the earbud controller determines that the earbud is not still inserted into the ear of the user, for example, by determining that the capacitance between one or more pairs of conductive traces decreased to a level inconsistent with the earbud being disposed in the ear canal of the user, the method may proceed to act 635 and the earbud may provide the indication of improper insertion and be deactivated if not determined to be inserted into the ear of the user prior to expiration of the second timer (acts 640-655).

It is to be understood the method illustrated in FIG. 6 may also be applicable to earbuds having a conductive trace or conductive coating internal to the canal portion of the earbud, for example, as in the earbud illustrated in FIG. 3*b*. The method illustrated in FIG. 6 may also be applicable to detecting proper insertion of both earbuds in a pair of earbuds. For example, in decision acts 620, 650, and 660, the earbud controller may make a determination if one or both of the earbuds in a pair of earbuds are properly inserted into the ear of a user, may cause audio content to be rendered through one or both earbuds in act 630, and may deactivate one or both earbuds in the pair in act 655.

Having thus described several aspects of at least one implementation, it is to be appreciated various alterations, modifications, and improvements will readily occur to those skilled in the art. Such alterations, modifications, and improvements are intended to be part of this disclosure, and are intended to be within the spirit and scope of the disclosure. The acts of methods disclosed herein may be performed in alternate orders than illustrated, and one or more acts may be omitted, substituted, or added. One or more features of any one example disclosed herein may be combined with or substituted for one or more features of any other example disclosed. Accordingly, the foregoing description and drawings are by way of example only.

The phraseology and terminology used herein is for the purpose of description and should not be regarded as limiting. As used herein, the term "plurality" refers to two or more items or components. As used herein, dimensions which are described as being "substantially similar" should be considered to be within about 25% of one another. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. An earbud comprising:

a capacitive sensor including at least one conductive trace, the at least one conductive trace being constructed and arranged to exhibit a capacitance that increases with a depth of insertion of the earbud in an ear of a user; and a controller configured to provide an indication of the earbud being inserted into the ear of the user and to provide an indication of the depth of insertion of the earbud in the ear of the user responsive to detecting changes in capacitance of one of the at least one conductive trace relative to ground or different conductive traces relative to one another.

2. The earbud of claim 1, wherein the earbud further comprises a nozzle configured to be inserted into at least an entrance of an ear canal of the user and the at least one conductive trace is disposed on the nozzle.

3. The earbud of claim 2, wherein the at least one conductive trace includes portions extending at least partially about a perimeter of the nozzle.

4. The earbud of claim 2, further comprising a conductive element disposed within the nozzle, the controller being configured to detect changes in capacitance between the conductive element and the at least one conductive trace.

5. The earbud of claim 1, further comprising an insulator disposed on the at least one conductive trace.

6. The earbud of claim 1, further comprising redundant conductive traces, the controller being configured to calibrate the capacitive sensor based on a capacitance between the redundant conductive traces.

7. The earbud of claim 1, wherein the controller is further configured to provide feedback to the user of whether the earbud is inserted into the ear of the user.

8. The earbud of claim 1, wherein the controller is further configured to differentiate between signals from the capacitive sensor indicative of insertion of the earbud in the ear of the user and signals from the capacitive sensor indicative of manual handling of the earbud.

9. The earbud of claim 1, wherein the controller is further configured to cause the earbud to transition from an active state to an inactive state responsive to the capacitive sensor providing a signal indicative of the earbud being removed from the ear of the user.

10. The earbud of claim 1, wherein the controller is further configured to cause the earbud to transition from an active state to an inactive state responsive to the capacitive sensor failing to providing a signal indicative of the earbud being inserted into the ear of the user after a set time after activation of the earbud.

11. The earbud of claim 1, wherein the indication of the depth of insertion of the earbud in the ear of the user includes one of sound pulses or tones emitted by an acoustic driver of the earbud that vary depending on a degree of insertion of the earbud into the ear of the user, or an output provided on a user interface of an application running on a device wirelessly connected to the earbud.

12. A method of reducing power consumption of an earbud, the method comprising:

determining whether the earbud is inserted into an ear of a user based on a measurement of capacitance of one of at least one conductive trace disposed on the earbud relative to ground or different conductive traces disposed on the earbud relative to one another;

determining a degree of insertion of the earbud into the ear of the user from the measurement of capacitance; and causing the earbud to transition from an active state to an inactive state responsive to determining that the earbud is not inserted into the ear of the user for more than a threshold amount of time.

13. The method of claim 12, further comprising causing the earbud to transition from the active to the inactive state responsive to failing to determine that the earbud is inserted into the ear of the user after a set time after the earbud is placed into the active state.

14. The method of claim 12, further comprising causing the earbud to transition from the active to the inactive state responsive to determining that the earbud has transitioned from a state in which the earbud is inserted into the ear of the user to a state in which the earbud is not inserted into the ear of the user.

15. The method of claim 12, further comprising providing feedback to the user regarding a depth of insertion of the earbud into the ear of the user through one of the earbud or a device in communication with the earbud.

16. The method of claim 12, further comprising determining a degree of seal of the earbud in the ear of the user from the measurement of capacitance.

17. The method of claim 16, further comprising instructing the user to reposition the earbud to achieve a better seal of the earbud in the ear of the user.

18. The method of claim 16, further comprising modifying noise cancelling functionality of the earbud based on the degree of seal.

19. The method of claim 12, further comprising detecting movement of the earbud within the ear of the user based on the measurement of capacitance.

20. The method of claim 12, further comprising calibrating a capacitance meter in electrical communication with the at least one conductive trace by setting a reference capacitance at a capacitance detected between redundant traces disposed on the earbud.

21. The method of claim 12, wherein the at least one conductive trace is disposed on an outside of a nozzle of the earbud and the method comprises obtaining the measurement of capacitance readings by measuring capacitance between the at least one conductive trace and a conductive element disposed within the nozzle.

22. A method of detecting insertion of an earbud into an ear of a user, the method comprising:

measuring a capacitance of one of at least one conductive trace disposed on the earbud relative to ground or different conductive traces disposed on the earbud relative to one another;

determining a degree of insertion of the earbud into the ear of the user from the measurement of capacitance; and providing an indication of the earbud being inserted into the ear of the user responsive to the capacitance exceeding a threshold capacitance value.

23. The method of claim 22, wherein measuring the capacitance comprises measuring the capacitance between a set of conductive traces disposed on a nozzle of the earbud.

24. The method of claim 22, wherein measuring the capacitance comprises measuring the capacitance between a conductive trace disposed on a nozzle of the earbud and a conductive element disposed with the nozzle.

25. The method of claim 22, wherein the indication of the earbud being inserted into the ear of the user includes one of a click or a tone emitted by the earbud.

* * * * *